United States Patent [19]

Michelbrink

[11] 3,933,328

[45] Jan. 20, 1976

[54] APPARATUS FOR RECEIVING REFUSE

[76] Inventor: Peter Werner Michelbrink, 420 Park Place, Fort Lee, N.J. 07034

[22] Filed: Oct. 25, 1974

[21] Appl. No.: 517,816

[52] U.S. Cl. ..... 248/146; 248/DIG. 7; 211/4

[51] Int. Cl.[2] ..... A47G 23/02

[58] Field of Search ..... 248/DIG. 7, 95–98, 248/146, 147, 148, 149, 152, 156, 174, 176, 248/309, 346, 109, 203, 154; 211/4, 9, 64, 71, 211/72; 70/57–59, 62, 63; 292/238, 205, 304

[56] References Cited

UNITED STATES PATENTS

| | | | |
|---|---|---|---|
| 570,343 | 10/1896 | Streberg | 248/97 |
| 748,387 | 12/1903 | Lilly | 248/97 |
| 1,779,867 | 10/1930 | Ahrold | 248/146 |
| 2,304,810 | 12/1942 | Fetterman | 248/DIG. 7 |
| 3,003,728 | 10/1961 | Shaw | 248/154 |
| 3,028,134 | 4/1962 | Nolen | 248/DIG. 7 |
| 3,128,981 | 4/1964 | Puetsch et al. | 248/146 |
| 3,197,032 | 7/1965 | Stanley | 248/147 X |
| 3,276,733 | 10/1966 | Rosser | 248/DIG. 7 |

*Primary Examiner*—Roy D. Frazier
*Assistant Examiner*—Terrell P. Lewis
*Attorney, Agent, or Firm*—Hubbell, Cohen & Stiefel

[57] ABSTRACT

An apparatus for receiving refuse, such as a refuse container or a garbage can, is vertically insertable into a holder device therefor with the holder comprising a ring-like portion circumferentially extending about the inserted container which portion has openings therein through which the closed loop handles of the container may be inserted. The closed loop handles outwardly extend from the sides of the container in the direction of the sides and are slidably insertable on the ring-like portion adjacent the opening when the inserted container is rotated after insertion. Pivotally mounted locking bars are included in the ring-like portion adjacent the openings for locking these openings after the handles have been slidably inserted onto the ring-like portion to lock the container to the holder device. The holder is anchored, such as by concrete and/or an embedded base to prevent ready removal of the holder. The bottom of the container may comprise a concave-like portion to facilitate rotation of the container after insertion in the holder.

7 Claims, 7 Drawing Figures

FIG. 1
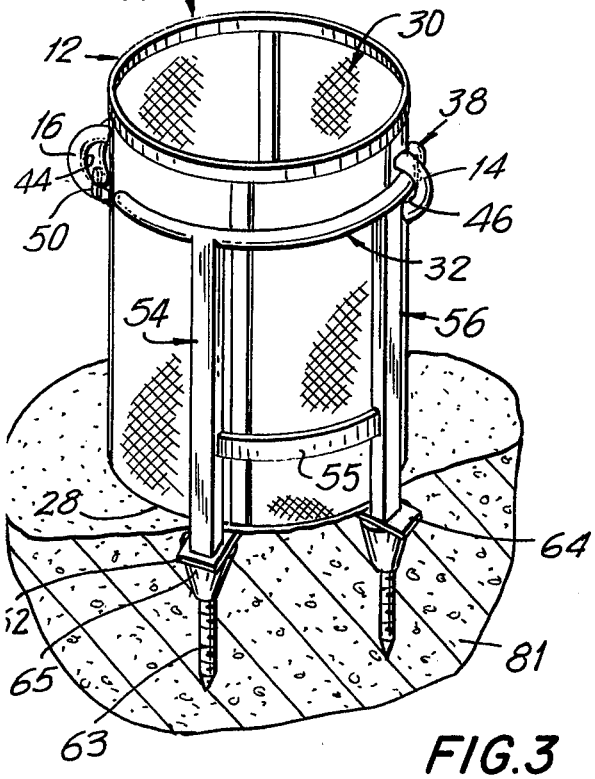
FIG. 2
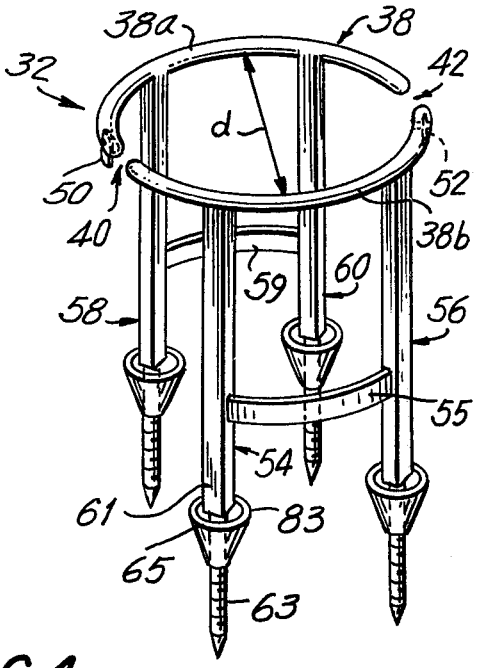
FIG. 3
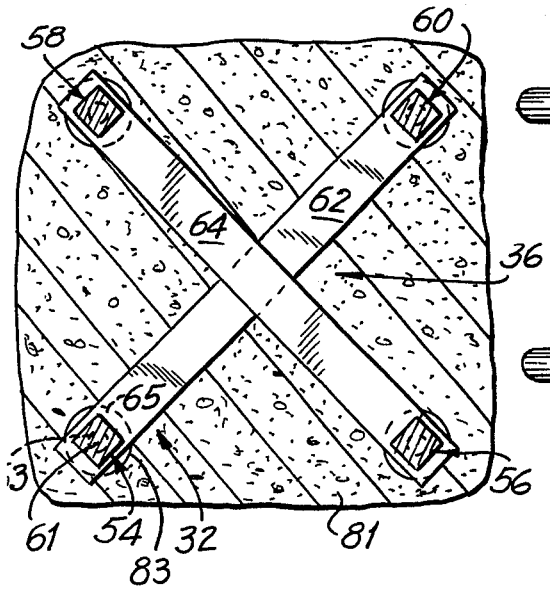
FIG. 4
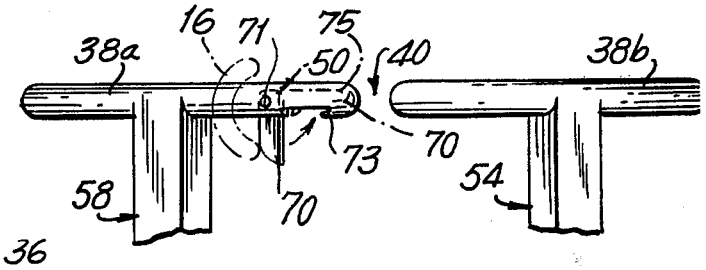
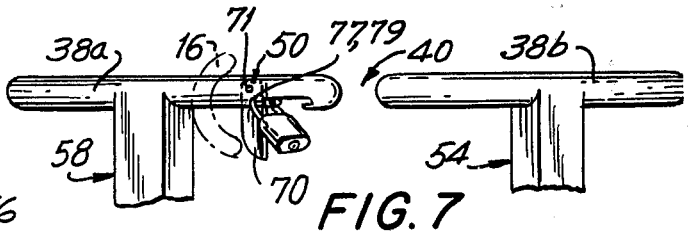
FIG. 7
FIG. 5
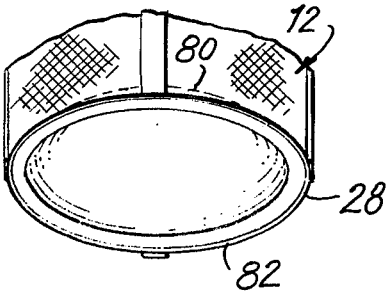
FIG. 6
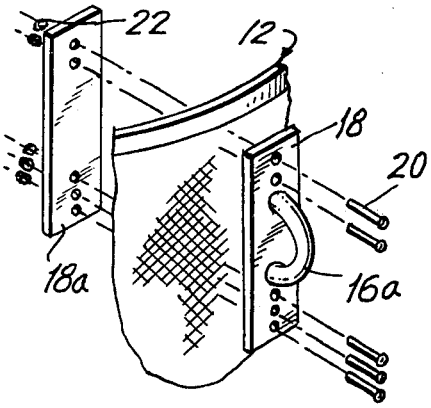

APPARATUS FOR RECEIVING REFUSE

BACKGROUND OF THE INVENTION

1. Field of the Invention

The present invention relates to devices for lockably holding refuse containers to prevent their unauthorized removal.

2. Description of the Prior Art

Holders for refuse cans are well known in the prior art, such holders being illustrated by way of example in U.S. Pat. Nos. 3,160,380; 2,795,336; 3,235,094; 3,675,783; 3,197,032; 3,288,305; and 3,219,195. All of these prior art refuse can holders, however, are primarily concerned with the problem of supporting these cans off the ground as well as maintaining the cans from tipping or upsetting from the elements or animals. Unfortunately, one of the primary problems with respect to garbage cans, such as in urban areas, is the environmental damage done, not from animals, but rather from human vandals who physically remove the cans from such holders and dump the contents over the surrounding landscape. In an attempt to overcome this problem in urban areas, costly and expensive materials have been utilized for constructing garbage cans, such as structural concrete. In todays economy, the costs of such materials does not justify their use as mere refuse containers. However, because the vandalism problem in urban areas is so great, municipalities have inefficiently expended large sums of money to provide these inefficient elaborate garbage cans. In those areas where the cost was not truly justified, such as in the large majority of parks contained in large urban areas, conventional wire garbage cans have continued to be utilized with the unfortunate result that environmental pollution by vandals continues in those areas where the police are unable to prevent it. Thus, prior art refuse can holders, such as the type enumerated above, have not proved satisfactory in overcoming the problems which can result from vandalism, including the problem of theft, as well as also preventing tipping and upsetting from the elements or animals. These disadvantages of the prior art are overcome by the present invention.

SUMMARY OF THE INVENTION

An apparatus for receiving refuse is provided which comprises a removable refuse container, such as a garbage can, having substantially up-standing sides providing a predetermined diameter for the container and a closed loop handle outwardly extending from at least one of the sides, the closed loop extending substantially in the direction of that side. Preferably, there will be at least two such loop handles. If desired, the handle may be removably secured to the container. In addition, the container may have a bottom portion which comprises a concave-like portion which provides a rim on which the container may be readily rotated. The apparatus further includes a holder device for the container with the holder comprising a circumferentially extending housing having a diameter greater than the diameter of the container. The container is removably insertable in the circumferential housing which includes a ring-like portion circumferentially extendable about the inserted container. The ring-like portion has an opening therein, through which the closed loop handle of the container is insertable when the container is inserted in the housing. The handle is slidably insertable in the ring-like portion adjacent the opening when the inserted container is rotated such as on the bottom rim. The ring-like portion has a pivotal locking bar adjacent the opening, which locking bar may be locked into position at substantially right angles to the ring-like portion to thereby prevent the container from being rotated back to a position at which the handles can be removed from the opening. Thus, removal of the container is prevented when the locking bar is locked into position. The holder further includes anchoring means, such as a concrete and/or a ground embeddable base portion, for preventing ready removal of the container locked holder, whereby the refuse container may be inserted in the holder and locked in place. The ring-like portion preferably includes a pair of uniformly spaced apart openings, each having pivotal locking bars associated therewith for lockably retaining the handles of the container, with the spacing of the openings being dependent on the spacing between a pair of closed loop handles normally provided on the refuse container.

BRIEF DESCRIPTION OF THE DRAWINGS

FIG. 1 is a perspective view of the preferred embodiment of the refuse receiving apparatus of the present invention;

FIG. 2 is a perspective view of the preferred embodiment of the holder portion of the embodiment shown in FIG. 1;

FIG. 3 is a plan view of an anchoring means utilizable with the embodiment of FIG. 1;

FIG. 4 is a fragmentary side elevational view of the embodiment shown in FIG. 2 illustrating the pivotal locking portion thereof;

FIG. 5 is a partial fragmentary perspective view of the preferred embodiment of the refuse container portion of the embodiment shown in FIG. 1;

FIG. 6 is an exploded fragmentary perspective view of the handle portion of the preferred container portion of the embodiment shown in FIG. 1; and FIG. 7 is a fragmentary side elevational view of an alternative embodiment of the pivotal locking portion shown in FIG. 4.

DETAILED DESCRIPTION OF THE PREFERRED EMBODIMENTS

Referring now to the drawings in detail and initially to FIG. 1 thereof, the presently preferred embodiment of the apparatus of the present invention for receiving refuse, generally referred to by the reference numeral 10 is shown. As shown and provided in FIG. 1, the apparatus 10 of the present invention may preferably be utilized with a conventional refuse container or garbage can 12, such as the type normally constructed by a steel wire mesh and utilized in a large majority of urban areas, such as New York City. Such trash cans 12, are ordinarily conventionally provided with closed loop handles, such as handles 14 and 16, to facilitate the lifting of the container 12 when it is desired to dump the contents thereof into a common collection device, such as a garbage truck. As shown in FIG. 6, however, if such a container 12 is not normally provided with vertically extending closed loop handles, such as handles 14 and 16, outwardly extending from the sides of the container 12, then such vertically extending handles, for example handle **16*a* which is afixed to the mounting plates 18 and 18*a*, may be permanently secured to the sides of the refuse container 12, such as by welded arrangements 20–22** as illustrated in FIG. 6.

As shown and preferred, and as will be described in greater detail hereinafter, the container 12 is closed on the bottom 28 thereof and is normally preferably only open at the top 30 thereof for permitting the insertion of refuse into the container 12.

Thus, the container 12 is normally closed on all sides except for the top portion 30. Preferably, the container 12 has a predetermined diameter which is conventionally provided by the spacing between the upstanding sides of the container 12. The apparatus 10, in addition to the container 12, also preferably includes a holder 32 for the refuse container 12 which, as will be described in greater detail hereinafter, enables insertion of the refuse container 12 therein and locking of the refuse container 12 in place to the holder 32. As shown and preferred in FIG. 3, the holder 32 preferably includes an anchoring portion 36 for anchoring a holder 32 in the ground to prevent easy removal of the holder 32. The manner of anchoring will be described in greater detail hereinafter. The holder 32 preferably comprises a circumferentially extending ring-like portion 38 (FIG. 2) which preferably has a diameter d which is greater than the diameter of the refuse container 12 insertable therein. As shown and preferred in FIG. 2, the ring-like portion 38 preferably comprises a pair of symmetrical portions 38*a* and 38*b* which are spaced apart to provide a pair of opposed openings 40 and 42 in the circumferential ring-like portion 38. The openings 40 and 42 are preferably of sufficient size to permit the insertion of the handles 14 and 16, respectively, through when the container 12 is inserted inside the holder 32. The handles 14 and 16, which were previously mentioned, are preferably located at a height sufficient to align the openings 44 and 46, respectively, therein with the ends of the ring-like symmetrical portions 38*a* and 38*b* when the container 12 has been inserted in the holder 32. As will be described in greater detail hereinafter with reference to FIG. 4, openings 40 and 42 are preferably lockably closed by conventional pivotal locking means 50 and 52, respectively. The holder 32 also preferably comprises a pair of upstanding supporting members 54 and 56 for ring-like portion 38*b*, said supporting members being joined together by cross member 55 and supporting members 58 and 60 for ring-like portion 38*a*, said supporting members being joined together by cross member 59 to permanently support the ring-like portion 38 at the desired height. The structure of supporting member 54 will now be further described in detail, it being understood that supporting members 56, 58 and 60 are similarly considered. Supporting member 54 comprises an elongate portion 61 extending downwardly from portion 38*b*, and terminates in a threaded portion 63 having a pointed tip for ease of anchoring supporting member 54. Supporting member 54 also includes an internally threaded, conical shaped screw 65 which is threadably mountable on threaded portion 63. Screw 65, together with identical screws on each of supporting members 56, 58 and 60 are all independently threaded on their respective threaded portions whereby to ensure that the holder 32 will be in a level position, as for example, when the ground in which holder 32 is itself not level. It is these supporting members 54, 56, 58 and 60 which are anchored in the ground by the previously mentioned anchoring means 36 by affixing the holder 32 in substantially permanent position in the ground. Preferably, as shown and preferred, portions 38*a* and 38*b* are at the same vertical height.

The anchoring means for anchoring supporting members 54, 56, 58 and 60 in the ground may preferably be by means of concrete which has been poured into the ground as shown in FIG. 3. In FIG. 3, an X-shaped cross plate 36 having cross members 62 and 64 in fixed position corresponding to supporting members 54, 56, 58 and 60 is removably secured to the bottoms of the supporting members 54, 56, 58 and 60 with cross member 62 interconnecting supporting members 54 and 60 and cross member 64 interconnecting supporting members 56 and 58. Thus, cross plate 36 is embedded in the ground, such as by means of concrete for anchoring the holder 32 to the ground so as to prevent removal thereof.

In securing the holder 32 to the ground, the cross plate 36 is secured to the bottoms of supporting members 54, 56, 58 and 60 by means of the conical screws 65. Then, fresh concrete 81 is poured into a hole in the ground at the place where it is desired to mount holder 32. While the concrete is still wet, the holder 32 having cross plate 36 secured thereto, is placed on the concrete. Threaded portions 63 and conical screws 65 are submerged in the concrete and held in place until the concrete is fully set. In this manner, the holder 32 is securely fixed in the ground because the threaded portions 63 tend to grip the concrete making movement or removal virtually impossible. Moreover, the base, or wide portions 83 of conical screws 65 also prevents movement or removal of the holder 32 from the ground.

With respect to the pivotal locking means 50 and 52 previously mentioned with respect to FIG. 2, one such typical pivotal lock 50 being illustrated in FIG. 4, the lock 50 or 52 preferably comprises a locking bar 70 pivotally mounted to the ring-like portion 38*a* by, for example, a bolt 71 for pivotal movement from an open position shown by dotted lines 75 in which the locking bar 70 is substantially parallel to ring-like portion 38*a* and rests on shoulder 73, the adjacent opening 40 permits insertion of the handle 14 therein, to a closed position, in which the locking bar 70 is at substantially right angles to ring-like portion 38*a* and thereby prevents the movement of the handle 16 beyond the locking bar, whereby removal of the garbage can from the holder is effectively prevented. In this embodiment, ring-like portion 38*a* includes a built-in lock (not shown) for locking the locking bar 70 in its closed position. As was previously mentioned, the structure and operation of the pivotal lock 52 is identical with that previously described for lock 50. In an alternative embodiment of the pivotal locking means 50 and 52 shown in FIG. 7, locking bar 70 is provided with an aperture 77 and ring-like portion 38*a* is also provided with an aperture 79, which apertures are in alignment when the locking bar 70 is in the closed position as shown in FIG. 7. In this closed position, a conventional padlock or combination lock is inserted through apertures 77 and 79 whereby to lock the locking bar into its closed position.

Referring now to FIG. 5, the bottom 28 of the container 12, if desired, may comprise a concave-like portion 80 of minimal depth so as to provide a rim 82 on the bottom 28 so as to facilitate the rotational movement of the container 12 when it is inserted in the holder 32. The arrangement of FIG. 5, therefore decreases the drag or friction of the container 12 so as to facilitate the rotation thereof in the holder 32.

In utilizing the apparatus 10 of the present invention, the container 12 is inserted in the holder 32 by first aligning the handles 14 and 16 with the openings 40 and 42 in the ring-like portion 38 and, thereafter, inserting the container 12 in the holder 32 through the ring-like portion 38. The loops 44 and 46 in handles 14 and 16 are respectively aligned with the ring-like portions 38*a* and 38*b* adjacent openings 40 and 42. The container 12 is then rotated about its base so as to slidably insert the handles 14 and 16 on to the adjacent ring-like portions 38*a* and 38*b* by inserting these portions through the loops 44 and 46. The locks 50 and 52 then have the locking bars pivoted to the closed position and locked in place to lock the container 12 to the holder 32.

By utilizing the apparatus of the present invention, refuse containers may be removably inserted in a holder therefore and locked in place to prevent vandalism or theft thereof as well as to maintain the cans against tipping and upsetting from the elements or animals.

What is claimed is:

1. A holder device for a refuse container, said refuse container having substantially upstanding sides providing a predetermined diameter for said container with a pair of circumferentially spaced apart closed loop handles outwardly extending from said sides with said closed loops extending substantially in the direction of said sides, said holder device comprising a circumferentially extending housing having a diameter greater than the diameter of said container, said container being removably insertable in said circumferentially extending housing, said housing having a ring-like portion circumferentially extendable about said inserted container, said ring-like portion comprising a pair of circumferentially spaced apart arcuate portions defining a pair of circumferentially spaced apart lockable openings in said ring-like portion through which said handles are insertable when said container is inserted in said housing, the circumferential spacing of said openings being dependent on the circumferential spacing between said handles, said handles of said container being simultaneously insertable through said openings and simultaneously slidably rotatable on said ring-like portion adjacent said openings when said inserted container is rotated, each of said arcuate portions comprising said ring-like portion having at least one intersecting portion extending downwardly therefrom adjacent a different one of said pair of openings for supporting said arcuate portion at a predetermined height above the ground and further comprising a pivotal locking means being disposed at a different one of said pair of openings for lockably retaining said handles to said ring-like portion to thereby prevent removal of said slidably inserted handles and thus removal of said container when said locking means locks said handles to said housing after said simultaneous slidable insertion and rotation of said handles, said pivotal locking means being pivoted to a locking position at each of said openings for locking said handles between said intersecting portions and said pivoted locking means for locking said handles to said ring-like portion while confining rotation thereon to the distance between said locked pivotal locking means and said adjacent intersecting portion, said housing further comprising anchoring means for anchoring said housing to the ground for preventing ready removal of said container locked housing, whereby the refuse container may be inserted in said holder therefor and locked in place.

2. A holder device in accordance with claim 1 wherein said intersecting portion comprises an upstanding supporting portion extending between said ring-like portion arcuate portion and said anchoring means, said supporting portion comprising an upstanding member insertable in said anchoring means for being fixedly anchored thereto.

3. A holder device in accordance with claim 1 wherein said openings are uniformly spaced from each other about said ring-like portion for providing a pair of substantially symmetrical portions for said arcuate portions, said intersecting portion for each of said symmetrical portions comprising an upstanding supporting portion extending between said ring-like portion and said anchoring means.

4. A holder device in accordance with claim 3 wherein each of said supporting positions comprises a pair of upstanding members insertable in said anchoring means for being fixedly anchored thereto.

5. A holder device in accordance with claim 2 wherein said anchoring means comprises a pair of ground embeddable intersecting members extending between said upstanding members which are diagonally opposed.

6. An apparatus for receiving refuse comprising a refuse container having substantially upstanding sides providing a predetermined diameter for said container with a pair of circumferentially spaced apart closed loop handles outwardly extending from said sides and with closed loops extending substantially in the direction of said sides, said container further having a bottom portion from which said sides extend, said bottom portion comprising a concave-like portion to provide a rim on which said container may be readily rotated; and a holder device for said refuse container, said holder device comprising a circumferentially extending housing having a diameter greater than the diameter of said container, said container being removably insertable in said circumferentially extending housing, said housing having a ring-like portion circumferentially extendable about said inserted container, said ring-like portion comprising a pair of circumferentially spaced apart arcuate portions defining a pair of circumferentially spaced apart lockable openings in said ring-like portion through which said handles are insertable when said container is inserted in said housing, the circumferential spacing of said openings being dependent on the circumferential spacing between said handles, said handles of said container being simultaneously insertable through said openings and simultaneously slidably rotatable on said ring-like portion adjacent said openings when said inserted container is rotated, each of said arcuate portions comprising said ring-like portion having at least one intersecting portion extending downwardly therefrom adjacent a different one of said pair of openings for supporting said arcuate portion at a predetermined height above the ground and further comprising a pivotal locking means being disposed at a different one of said pair of openings for lockably retaining said handles to said ring-like portion to thereby prevent removal of said slidably inserted handles and thus removal of said container when said locking means locks said handles to said housing after said simultaneous slidable insertion and rotation of said handles, said pivotal locking means being pivoted to a locking position at each of said openings for locking said handles between said intersecting portions and said pivoted locking means for locking said handles to said ring-like portion while confining rotation thereon to the distance between said locked pivotal locking means and said adjacent intersecting portion, said housing further comprising anchoring means for anchoring said housing to the ground for preventing ready removal of said container locked housing, whereby the refuse container may be inserted in said holder therefor and locked in place.

7. An apparatus for receiving refuse comprising a refuse container having substantially upstanding sides providing a predetermined diameter for said container with a pair of circumferentially spaced apart closed loop handles outwardly extending from said sides and with said closed loops extending substantially in the direction of said sides, said closed loop handles being securable to said upstanding sides; and a holder device for said refuse container, said holder device comprising a circumferentially extending housing having a diameter greater than the diameter of said container, said container being removably insertable in said circumferentially extending housing, said housing having a ring-like portion circumferentially extendable about said inserted container, said ring-like portion comprising a pair of circumferentially spaced apart arcuate portions defining a pair of circumferentially spaced apart lockable openings in said ringlike portion through which said handles are insertable when said container is inserted in said housing, the circumferential spacing of said openings being dependent on the circumferential spacing between said handles, said handles of said container being simultaneously insertable through said openings and simultaneously slidably rotatable on said ring-like portion adjacent said openings when said inserted container is rotated, each of said arcuate portions comprising said ring-like portion having at least one intersecting portion extending downwardly therefrom adjacent a different one of said pair of openings for supporting said arcuate portion at a predetermined height above the ground and further comprising a pivotal locking means being disposed at a different one of said pair of openings for lockably retaining said handles to said ring-like portion to thereby prevent removal of said slidably inserted handles and thus removal of said container when said locking means locks said handles to said housing after said simultaneous slidable insertion and rotation of said handles, said pivotal locking means being pivoted to a locking position at each of said openings for locking said handles between said intersecting portions and said pivoted locking means for locking said handles to said ring-like portion while confining rotation thereon to the distance between said locked pivotal locking means and said adjacent intersecting portion, said housing further comprising anchoring means for anchoring said housing to the ground for preventing ready removal of said container locked housing, whereby the refuse container may be inserted in said holder therefor and locked in place.

* * * * *

UNITED STATES PATENT OFFICE

CERTIFICATE OF CORRECTION

Patent No. 3,933,328 Dated January 20, 1976

Inventor(s) PETER WERNER MICHELBRINK

It is certified that error appears in the above-identified patent and that said Letters Patent are hereby corrected as shown below:

Title page, left side, in the inventor's address: "420 Park Place, Fort Lee, N.J. 07034" should read -- 420 Park Place, Fort Lee, N.J. 07024 --.

Signed and Sealed this

*first* Day of *June 1976*

[SEAL]

*Attest:*

RUTH C. MASON
*Attesting Officer*

C. MARSHALL DANN
*Commissioner of Patents and Trademarks*